United States Patent [19]

Budney

[11] 4,138,118

[45] Feb. 6, 1979

[54] GOLF CLUB GRIP TRAINING DEVICE

[76] Inventor: David R. A. Budney, 65 Alexander Parade, Charlestown, N.S.W., Australia

[21] Appl. No.: 802,795

[22] Filed: Jun. 2, 1977

[30] Foreign Application Priority Data

Jun. 11, 1976 [Au] Australia ..... 6237/76

[51] Int. Cl.[2] ..... A63B 69/36

[52] U.S. Cl. ..... 273/183 D; 273/186 A

[58] Field of Search ..... 273/183 D, 193 R, 194 R, 273/162 R, 81.4, 81 B, 26 B, 186 A; 35/25, 29 A

[56] References Cited

U.S. PATENT DOCUMENTS

| | | | |
|---|---|---|---|
| 3,270,564 | 9/1966 | Evans | 273/186 A X |
| 3,323,367 | 6/1967 | Searle | 273/183 D |
| 3,380,305 | 4/1968 | Charell | 273/26 B |
| 3,717,857 | 2/1973 | Evans | 273/186 A |
| 3,945,646 | 3/1976 | Hammond | 273/186 A |

FOREIGN PATENT DOCUMENTS

| | | | |
|---|---|---|---|
| 2631000 | 1/1977 | Fed. Rep. of Germany | 35/25 |

*Primary Examiner*—George J. Marlo

*Attorney, Agent, or Firm*—Lowe, Kokjer, Kircher, Wharton & Bowman

[57] ABSTRACT

A handle for a golf club is provided with pressure sensitive transducers at locations corresponding to the positions at which a right handed player exerts pressure with his right thumb and with the last three fingers of his left hand. The electrical outputs of the transducers are transmitted to a pen recorder which provides traces from which faults in the player's technique are apparent by a comparison of the traces obtained with corresponding traces produced by an expert golfer.

7 Claims, 12 Drawing Figures

GOLF CLUB GRIP TRAINING DEVICE

FIELD OF THE INVENTION

This invention relates generally to hand manipulated implements and is more specifically concerned with enabling a pupil to be taught how to grip correctly a handle of a golf club.

STATE OF THE ART

Instruction of learning golfers by teaching professionals is a process which in its current state, has been evolving since the game began. This instruction takes the form of emphasis of some required fundamentals as well as the recognition and correction of the pupil's faults. Some of these faults are very evident to a professional while others are less tangible and more difficult to recognise. Also, the ability to recognise certain faults in the way a golfer swings his club, varies from instructor to instructor, and depends to some extent on the instructor's own tendencies and recent experiences in the instructional field.

Problems a learning golfer encounters in mastering the correct stance, speed of movement and direction of movement are not hard to deal with by a professional teacher as they are visually apparent. However, a particularly difficult problem to detect and correct is the incorrect pressure and distribution of pressures applied to the handle by the grip of the golfer. Changes in the pressure during the swing of a golf club, which is of very short duration, can have a profound effect on the pupil's ability to improve his golf. Important consideration is thus given by professional golf teachers to the grip pressure of a pupil and there is a wealth of literature in existence on this subject. Some of the problems which arise from incorrect grip pressures are:

a. a premature wrist action which lessens the speed of the club head at impact with a consequential reduction in the distance travelled by the ball;
b. a tendency to strike the ground prior to hitting the ball;
c. a tendency to either "open" or "close" the club face;
d. a retardation of the swing caused by gripping the golf handle too tightly so that the pupil's muscles are excessively taut and the club movement is slower as a result; and,
e. a lack of consistency in the ability of the pupil to reproduce the same stroke under the same conditions.

The problem of a professional to diagnose a fault in a pupil's grip is that after the pupil golfer has attempted to adopt the remedy suggested by the professional, he often disagrees with the professional that he is still making the same error. Although video-tape systems have often been useful in showing the continued existence of this sort of problem, the cost of installation of a video-tape system and also limitation on the places in which it can be used militate against the extensive use of video-tape systems.

OBJECT OF THE INVENTION

An object of the invention is to provide a way of checking the extent to which a pupil is correctly manipulating a handle of a golf club so that imperfections in his grip may be corrected.

THE INVENTION

In accordance with the broadest aspect of the invention there is provided a golf club having a handle and a head, a first pressure sensitive transducer on the handle and positioned to sense the pressure exerted by a pincer finger action applied by one hand of a golfer, a second pressure sensitive transducer on the handle and positioned to sense the pressure exerted by a grip action applied by the other hand of a golfer, read-out means separate from the golf club, electrical signal transmission means linking each of the transducers to the read-out means, and means associated with the read-out means for providing a visual time-based display of a signal representative of pressure changes sensed by each of the transducers when the golfer executes a stroke.

PREFERRED FEATURES OF THE INVENTION

The electrical output of the transducers may be transmitted to the read-out equipment by wires or by radio telemetry. The advantage of the second technique is there are no leads or any other encumberances likely to interfere with the correct usage of the implement, the read-out equipment being physically separate from the handle.

As will be explained in more detail hereafter, the records provided by the read-out equipment enable a comparison to be made between the grip of a professional compared with the grip of a pupil. The record can be shown to the pupil and his style of using the implement improved in consequence. In the case of a golf club, research has shown that most of the problems involving grip can be detected by recording a pincer-finger action of the right hand, which has a finger grip, (to a right-handed player when executing a golf stroke) and the pressure exerted by the last three fingers of the left hand which has a palm-type grip. Although, if desired, the pressure under the left thumb can also be monitored, it has been shown, at least in the case of golf, the information obtained is also detectable from the records of the pincer-finger action of the right hand and the last three finger pressures of the left hand.

The invention will now be described in more detail, by way of example, by reference to the accompanying drawings, in which:

IN THE DRAWINGS

DESCRIPTION OF PREFERRED EMBODIMENT

Figure 1:
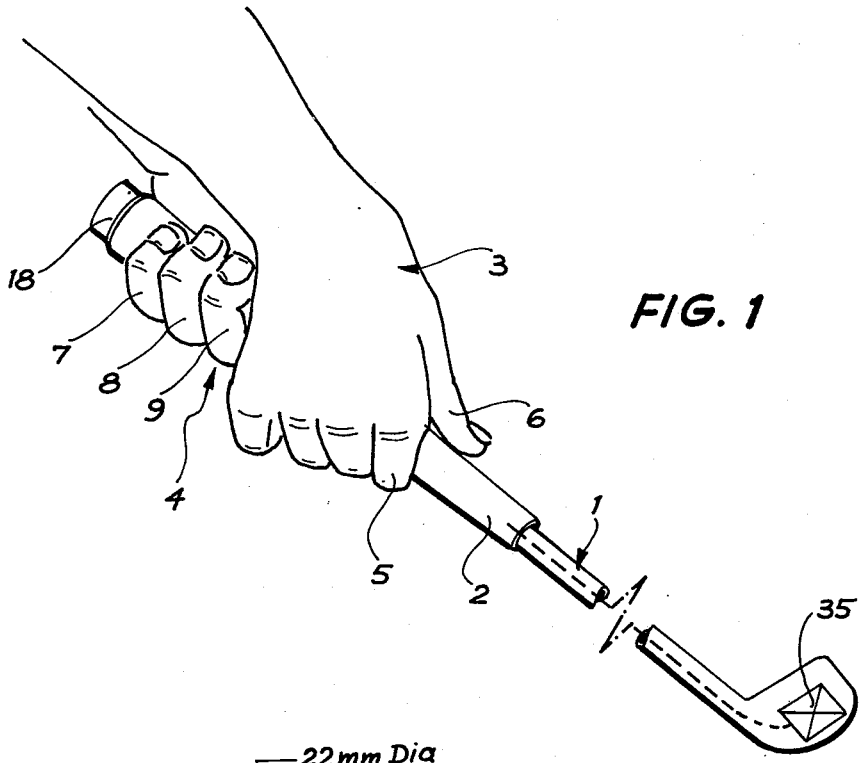
FIG. 1 illustrates diagrammatically a right-handed golfer's hold on the handle of a golf club which is shown partly broken away.

FIG. 1 shows head and handle portions of a golf club having a shaft 1. The handle 2 is illustrated gripped by a right-handed player with his right hand at 3, and his left hand at 4. Tests have shown that the most important pressures are those exerted by a pincer finger action of the right hand between the points 5 and 6, and the palm pressure exerted by the fingers of the left hand at points 7, 8 and 9.

Figure 2:
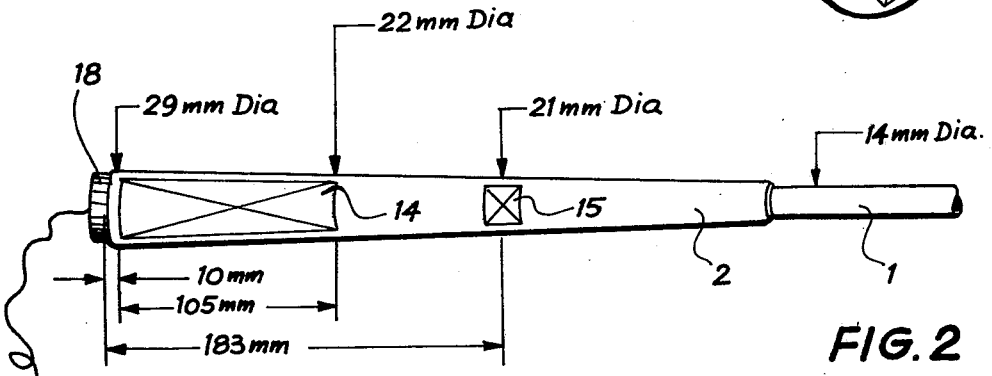
FIG. 2 shows the positions along the handle of a golf club where various pressures are monitored.

FIG. 2 shows the golf club handle 2 in more detail. The club has a shaft 1 diameter of 14mm and a handle 2 whose diameter increases progressively up to 29mm. The two zones of interest are referenced 14 and 15 in FIG. 2. The zone 14 corresponds to the points 7, 8 and 9 in FIG. 1 and occurs on the region of the shaft handle where its diameter decreases progressively from about 29mm to 22mm. In practice, the zone 14 commences about 10mm from the top of the handle and extends for a length of about 105mm in the direction of the shaft 1. The second zone 15 is about 20mm long and is centred about 183mm from the top of the handle. The handle diameter at this point is about 21mm.

Figure 3:
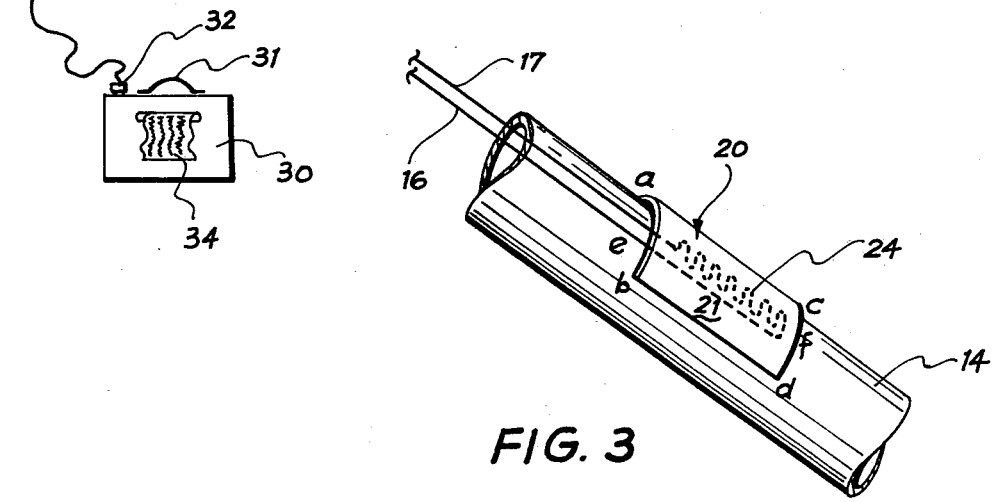
FIG. 3 shows a transducer fitted to a shaft of a golf club handle.

FIG. 3 shows the means which are used to sense the pressures at the points 5 to 9.

Electrical resistance transducers, such as that shown at 20 are located in each of the zones 14 and 15 beneath the handle binding, at positions where the thumb pressure of the right hand and the finger pressures of the left hand will be exerted on them. These positions are, of course, determined by the orientation of the golf head with respect to the axis of the golf handle. The transducer 20 is applied to the shaft 14 and comprises a part cylindrical stiffly resilient pad 21 made of steel and having four corners a, b, c, and d. The pad is ½mm thick. The radius of curvature of the pad 21 is slightly less than that of the outside of the shaft 14, so that the portion of the pad between e and f in FIG. 3 is deflected slightly away from the surface of the underlying shaft 14. The surface of the pad 21 between the points e and f is formed with a tensile strain gauge made of electrical resistance wire 24 (shown diagrammatically) so that changes in the curvature of the pad 20 produce a corresponding difference in electrical resistance in the strain gauge and consequential variation of current flow through a pair of wires 16 and 17 which extend to a plug socket 18 provided on the free end of the golf club handle. The plug socket is adapted to receive a plug connected to one end of the thin multicore cable 32 leading to read-out equipment 30 which can be positioned on the ground a few feet behind the golfer. A suitable form of read-out equipment is a Vishay P-350 strain indicator used in conjunction with an ultra-violet recorder and made by Vishay Technology, U.S.A. This has four channels each of which controls movement of the pen recorder across a strip of continuously moving paper 34. The equipment 30 has its own batteries and provides the supply circuits for the pressure transducers in the golf club handle.

A further transducer 35 is fixed to the back of the head of the club and is used to indicate the moment that impact with the ball occurs.

A further transducer (not shown) identical to that shown in FIG. 3, but smaller, may be provided at the position on the handle where the pressure of the golfers left-thumb is normally applied. The trace obtained from this further transducer is shown in FIGS. 4 to 9 which will be referred to later, but the information obtained from it is obtainable from the other transducers so that its presence in the handle is not strictly necessary although it was thought originally to be useful.

The read-out equipment 30 is portable and is equipped with a handle 31.

Each of FIGS. 4 to 9 shows four typical traces produced by the read out equipment 30 and which are referenced I, II, III and IV. These traces read, in time, from right to left. The top trace I is obtained from the transducer 35 on the club head and denotes the moment of impact; the trace II beneath it is obtained from the transducer which responds to the pincer-finger action of the right hand exerted between the points 5 and 6 of FIG. 1; the next trace III corresponds to the thumb pressure of the left hand. From experimental work so far conducted this trace III has been found to produce no useful information unobtainable from the other traces. The last trace IV is that obtained from the palm grip of the left-hand by the finger pressure at points 7, 8 and 9 (FIG. 1).

OPERATION OF PREFERRED EMBODIMENT

Figure 4:
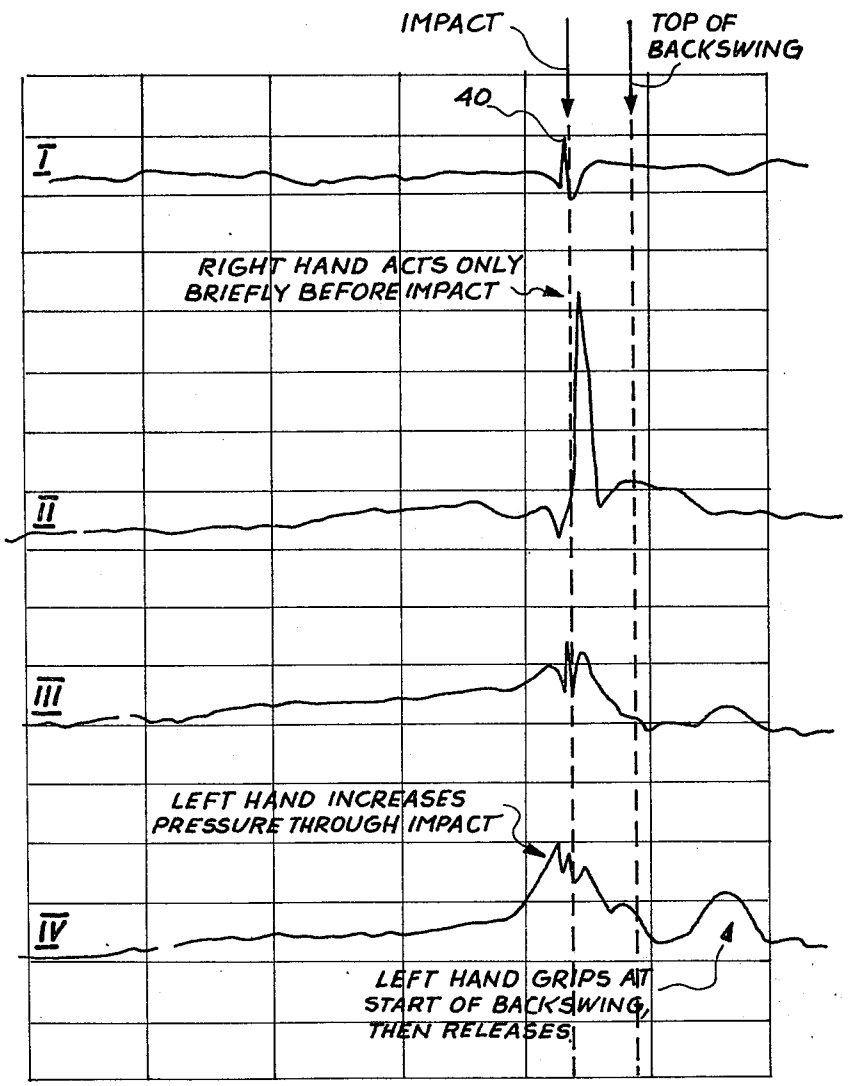

The traces shown in FIG. 4 are those of a professional golfer. The recorder 30 speed is 200cm of paper per minute which corresponds to 3⅓cm per second. The moment of impact of the head with the ball is clearly shown by the spike 40 in trace I. The top of the back swing preceeds this point by a quarter of a second (which corresponds to 9mm of paper) as is determined from high speed camera results. The average time for a total swing to take place is in the region of about 1.1 seconds.

Trace II of FIG. 4 shows that the pincer grip of the right hand comes into play only briefly before impact. On the other hand, trace IV shows, perhaps surprisingly, that when the golfer commences his back swing the grip of the left hand increases and then diminishes to a minimum at the top of the back swing and thereafter increases progressively during the forward swing until impact occurs.

Figure 5:
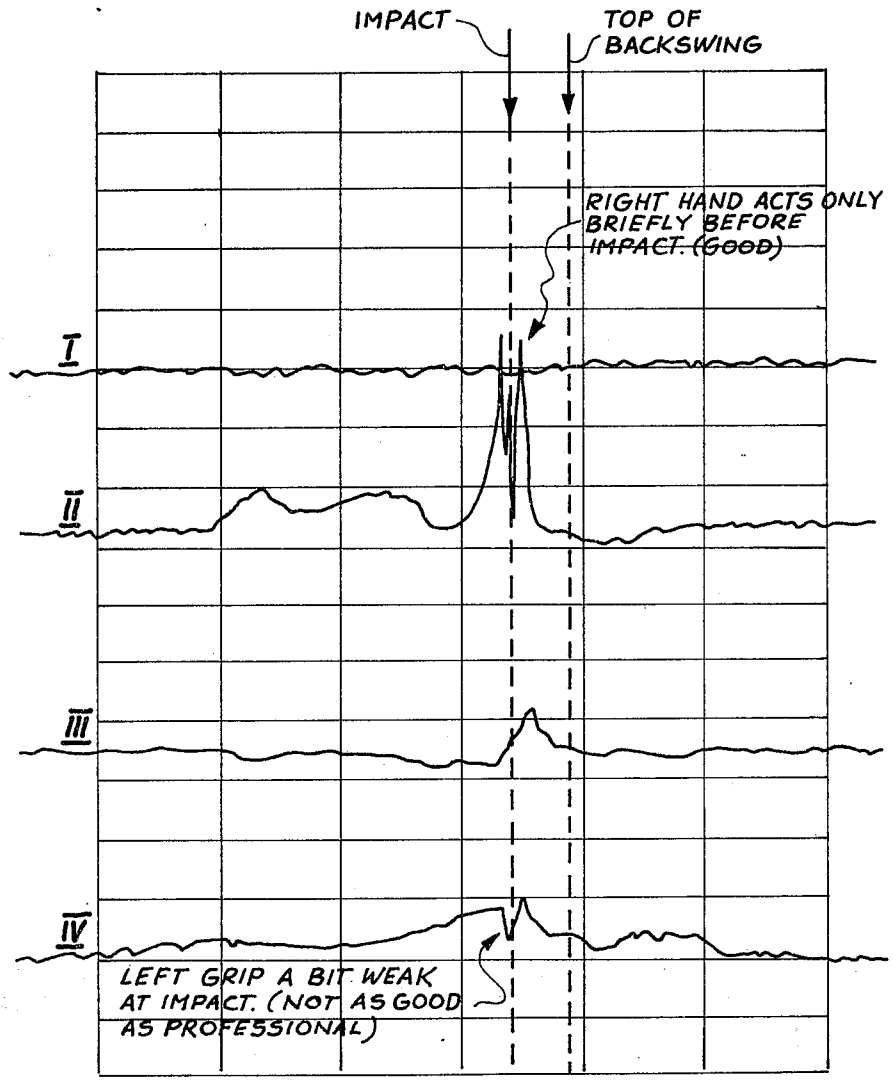
FIGS. 4 to 9 show respectively, six sets of transducer output traces obtained from the same golf club when used by different players of varying degrees of competence.

The set of traces shown in FIG. 5 are those obtained from an assistant professional golfer and trace II shows once again that the right-hand pincer action only comes into play briefly before impact. On the other hand, as is apparent from trace IV, the grip of the left-hand is weak compared with that of the professional golfer using the same club. The release of the left-hand at the top of the back swing is once again apparent from trace IV.

Figure 6:
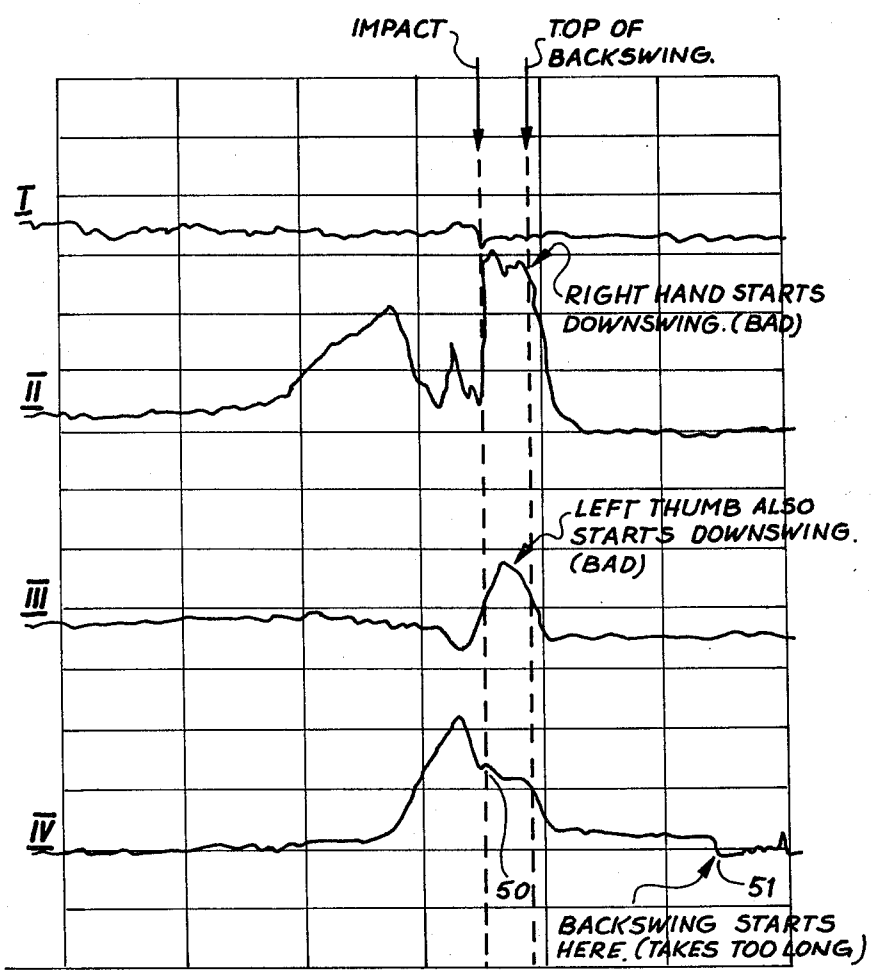

The curves shown in FIG. 6 are actually those of the inventor and show, from trace II, that the pincer action of the right hand is strong throughout the down-swing of the golf club. This is markedly different from the professionals. Also, the back swing takes too long as compared with the professional golfer's as is apparent from the time period between the impact point 50 and the point corresponding to the start of the back-swing which is clearly shown at 51.

Figure 7:
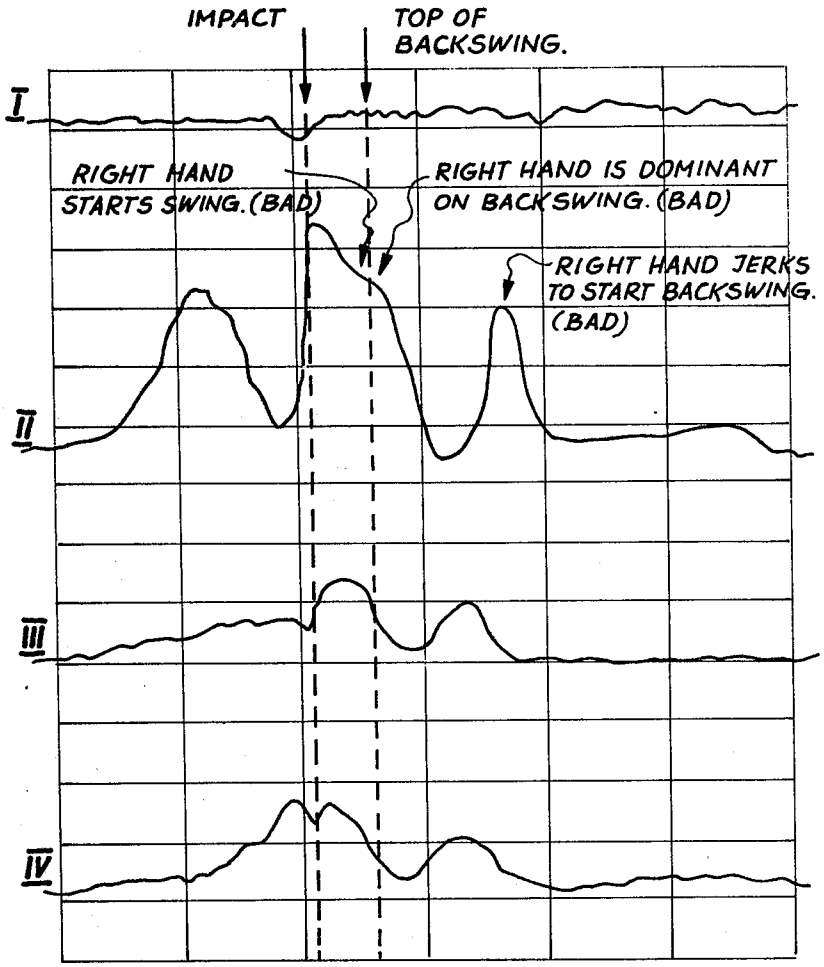

FIG. 7 shows traces obtained from a learner with a handicap of seventeen. This shows clearly the retention of the pincer grip of the right-hand throughout the down-stroke and also the pronounced jerky movement of the right hand used to start the back swing and which is apparent from trace II.

Figure 8:
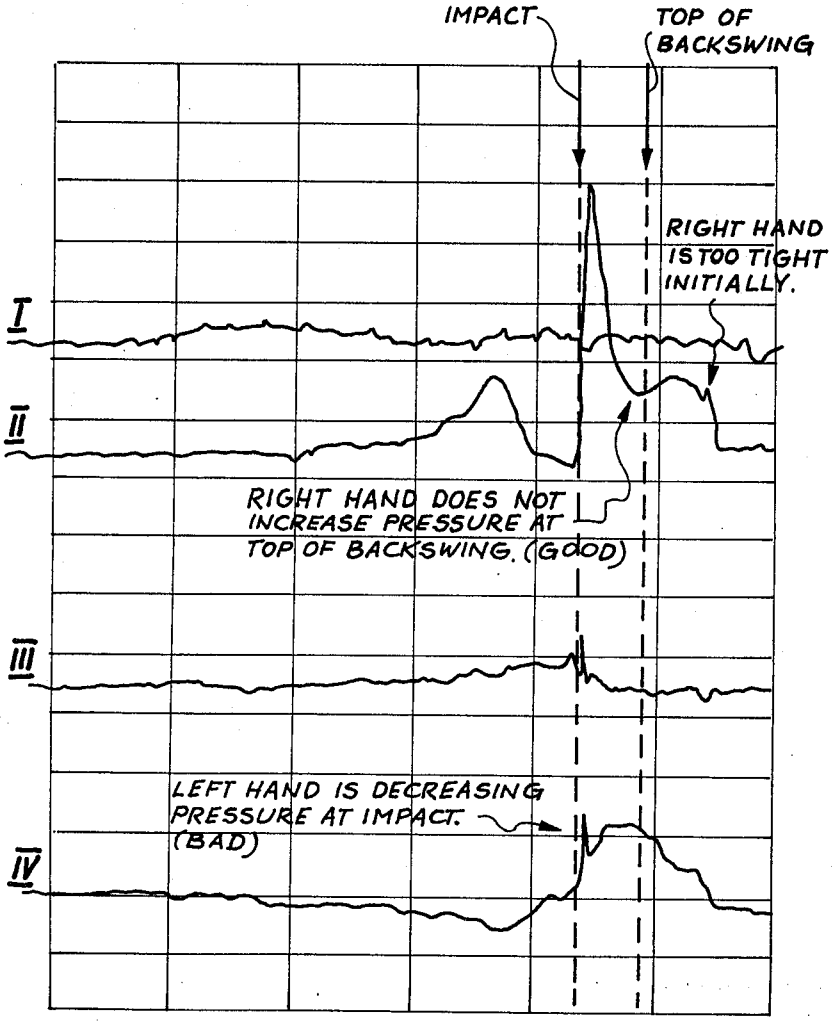

FIG. 8 shows the traces obtained from a golf player with a high handicap. The player's faults are immediately apparent in traces II and IV. From trace II it is apparent that the pincer grip of the right hand is too tight initially although the lack of any increase in pressure at the top of the back-swing until the approach to the impact is commenced, is a good sign as is apparent from the professional's records of FIGS. 4 and 5. A second fault which is apparent from trace IV of FIG. 8 is that the pressure curve of the left hand is falling away towards the moment of impact as compared with the corresponding curves of FIGS. 4 and 5.

Figure 9:
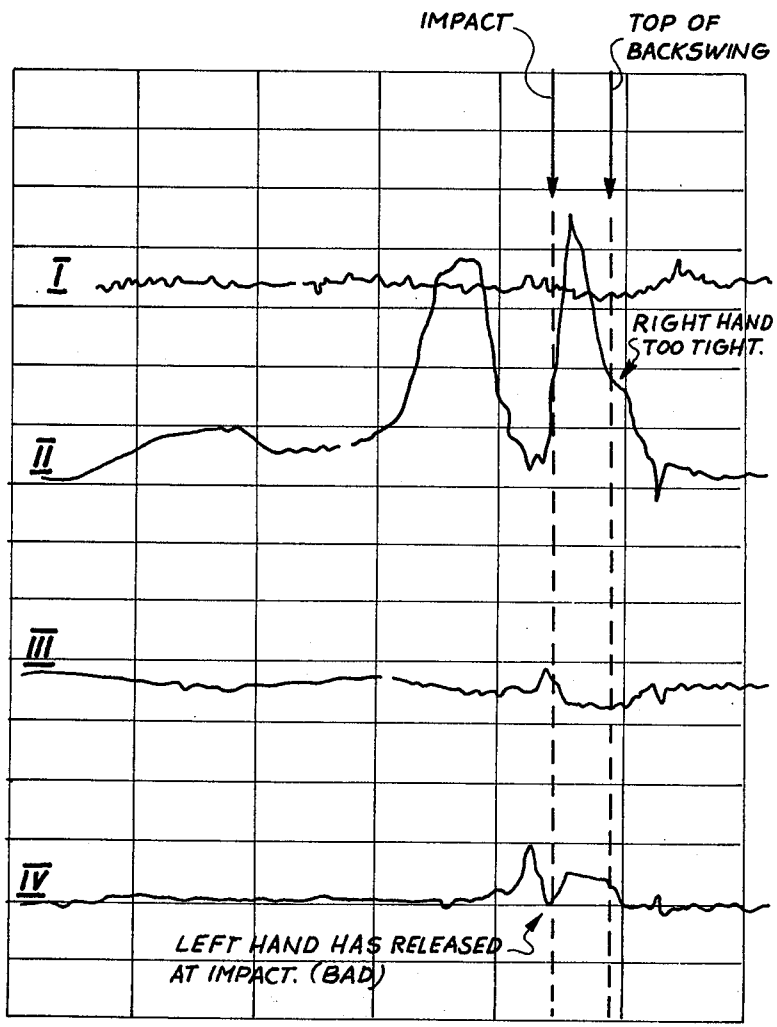

Finally, FIG. 9, shows the traces obtained from a fourteen year old boy learning to play golf. It is apparent that his right hand is held too tightly during the backlift, perhaps as a result of the weight of the club, and there is a relatively large drop in pressure exerted by the right hand and the left hand on the approach to the impact position.

It is hoped from further work in developing the invention, to be able to use it to assist the selection of the correct size of golf club handle for a particular player. Also it is hoped to distinguish the grip pressure variations through a range of different clubs in a set so that coaching assistance can be given on hand pressures to be used with different golf clubs.

MODIFICATIONS OF PREFERRED EMBODIMENT

Various modifications of the arrangement described are possible, for example, in place of using a physical connection in the form of the cable 32, a radio link may be used. In this case a radio telemetry transmitter incorporating a power source may be incorporated in the cap 18 on the handle instead of the plug socket and an aerial can be provided by a short length of wire extending along the handle beneath the binding. The read-out equipment 30 is provided with an aerial and incorporates a radio receiver matched to the handle transmitter. Such an arrangement has the advantage that the read-out equipment 30 and golf clubs are physically separate from one another and the pupil does not have his attention distracted by the trailing cable 32 while he is being coached.

Also, an accelerometer such as one commercially available from Eutran Devices, U.S.A., may be incorporated into the golf head in order to assist the reading of the grip pressure curves so that the top of the back swing can be correctly detected. Although in FIGS. 4 to 9 trace I shows clearly the moment of impact it is clear that the moment of impact can also be determined with a high degree of accuracy from considering traces II and IV alone. In other words, the use of traces I and III is redundant for many purposes and the transducers used in connection with them are not essential.

SECOND EMBODIMENT

Figures 10, 11, 12:
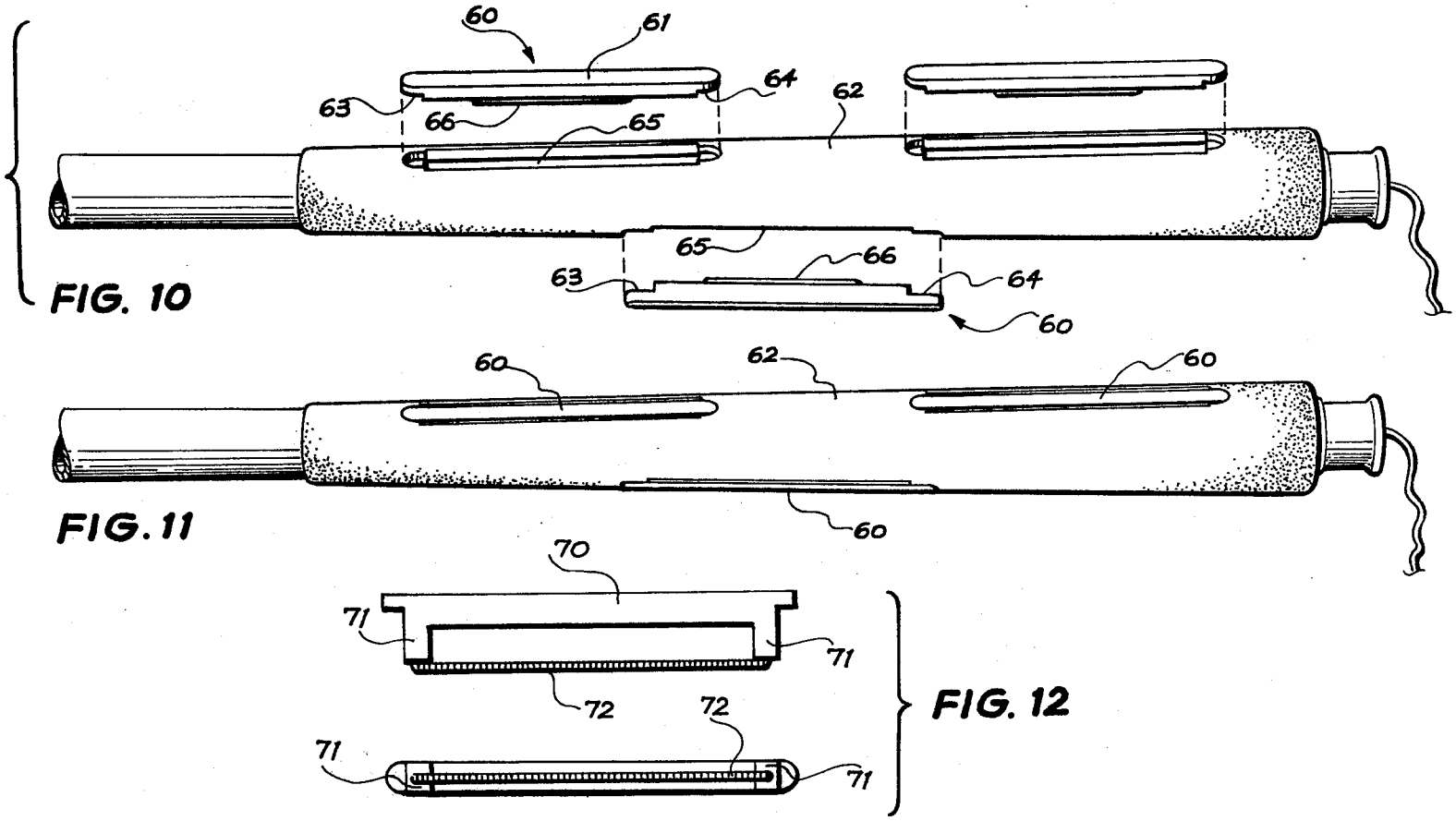
FIG. 10 shows an alternative form of transducer assembly to that shown in earlier Figures, together with a shaft of a golf club handle slotted at three positions to receive respective transducer assemblies.
FIG. 11 shows the shaft of FIG. 10 with the assemblies mounted in their slots; and, FIG. 12 shows side and plan views of an alternative form of transducer assembly to that shown in FIGS. 10 and 11 and for fitting in a slot of a golf club handle in similar manner to that described with reference to FIGS. 10 and 11.

FIG. 10 shows three transducer assemblies 60 which may be used instead of those shown in earlier Figures. Each assembly involves the use of a wooden beam 61 which is supported by a shaft 62 of a golf club handle at its ends 63 and 64. The beam fits into an axial slot 65 cut in the club handle so that there is a clearance between the sides of the beam 61 and the sides of the slot 65. The space beneath the beam 61 allows its intermediate portion to flex towards the shaft axis when the beam is subjected to finger pressure from a hand grip. The beam 61 carries a strain gauge 66 on its inner surface which serves as the transducer and varies its electrical resistance when the beam 61 is flexed. The ends of the slot 65 are stepped to receive the ends 63, 64 of the beam 61 so that when the beam 61 is fitted into the slot 65 its top surface is approximately flush with the surface of the handle shaft as shown in FIG. 11.

THIRD EMBODIMENT

In the modification shown in FIG. 12, a beam 70 is provided adjacent its opposite ends with legs 71 and fits into a slot as described in FIGS. 10 and 11. The legs 71 project into the interior of the slotted hollow club handle and have attached to their inner ends respective ends of a weldable strain gauge 72. Inward flexing of the beam 70 causes the legs 71 to diverge slightly so that the strain gauge 72 is tautened to provide an electrical output signal which is rather stronger, for a given grip, than that obtained from the strain gauges of earlier figures. The transducer assemblies of FIGS. 10 to 12 are located on the golf club handle at positions corresponding to those of the transducer 20 of earlier Figures.

Although the invention has been specifically described with reference to a golf club, it is applicable to any persuit where the changes in pressures and grip handle being used by a pupil are to be corrected.

I claim:

1. A golf club having a handle and a head, a first pressure sensitive transducer on the handle and positioned to sense the pressure exerted by a pincer finger action applied by one hand of a golfer, a second pressure sensitive transducer on the handle and positioned to sense the pressure exerted by a grip action applied by the other hand of a golfer, read-out means separate from the golf club, electrical signal transmission means linking each of the transducers to the read-out means, and means associated with the read-out means for providing a visual time-based display of a signal representative of pressure changes sensed by each of the transducers when the golfer executes a stroke.

2. A golf club as set forth in claim 1, in which said electrical signal transmission means comprises a flexible cable extending to said read-out means, the read-out means being portable and containing an electrical power source, and releasable connection means for attaching the cable to said handle.

3. A golf club as set forth in claim 1 in which said handle is formed on a shaft, each transducer comprises a resilient curved pad fitting around part of said shaft and of lesser radius than said shaft whereby an intermediate portion of said pad is urged by its resilience away from said shaft, a tensile strain gauge attached to said pad intermediate portion, and a binding around said pad and said shaft to provide said handle.

4. A golf club as set forth in claim 1, in which each transducer includes a tensile strain gauge fixed to a flexible beam spanning between the ends of a slot extending axially of a shaft in the handle, the beam being attached to the shaft at its ends only and having its portion between its ends able to flex inwardly with respect to the shaft to apply a strain to the gauge.

5. A golf club as set for in claim 4 in which the beam has legs adjacent its ends fixed to the shaft and an elongated strain gauge element is located inside the shaft and is attached at its ends to the free end-portions of the legs so that inward bowing of the intermediate portion of the beam causes a tensile strain to occur in the gauge.

6. A golf club as set forth in claim 1 and including accelerometer means on said head, electrical signal transmission means linking the accelerometer means to the read-out means, and said means associated with the read-out means being arranged to provide also a visual time-based display of a signal representative of acceleration of the club head.

7. A golf club as set forth in claim 1, wherein the electrical signal transmission means comprises a wireless transmission system, the handle of the club incorporating a power source, a transmitter for transmitting the signal representative of the pressure changes sensed by each of the transducers and transmitting antenna coupled to the transmitter for radiating said signals to a receiving antenna which is coupled to a receiving circuit associated with the read-out means.

* * * * *